United States Patent [19]

Bigley et al.

[11] Patent Number: 4,791,700

[45] Date of Patent: Dec. 20, 1988

[54] FRESNEL LENS ILLUMINATOR FOR VACUUM CLEANER

[75] Inventors: James E. Bigley, Warren, Ohio; Lee R. Estelle, Rochester, N.Y.

[73] Assignee: The Scott Fetzer Company, Cleveland, Ohio

[21] Appl. No.: 139,018

[22] Filed: Dec. 29, 1987

[51] Int. Cl.[4] ..... A47L 9/30

[52] U.S. Cl. ..... 15/324; 362/91; 362/339

[58] Field of Search ..... 15/324; 362/91, 330, 362/339

[56] References Cited

U.S. PATENT DOCUMENTS 2,208,523 7/1940 Cullman ..... 15/324 X
2,217,174 10/1940 Langille ..... 362/91
2,274,971 3/1942 White ..... 362/91 X

FOREIGN PATENT DOCUMENTS 389189 3/1933 United Kingdom ..... 15/324

*Primary Examiner*—Chris K. Moore
*Attorney, Agent, or Firm*—Watts, Hoffmann, Fisher & Heinke Co.

[57] ABSTRACT

An illumination system for a vacuum cleaner including a thermoplastic injection molded lens which, cooperating with a reflector surface, provides a high level of optical efficiency. The lens includes separate prism and diffusion areas which focus light immediately ahead of the cleaner. The lens and reflector allow a low wattage bulb to be utilized and thereby avoid excessive generation of heat and the requirement for a bulb socket for heat dissipation.

7 Claims, 2 Drawing Sheets

FIG. 1
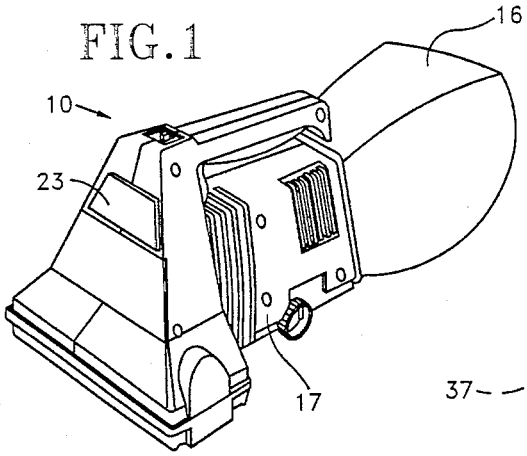
FIG. 2a
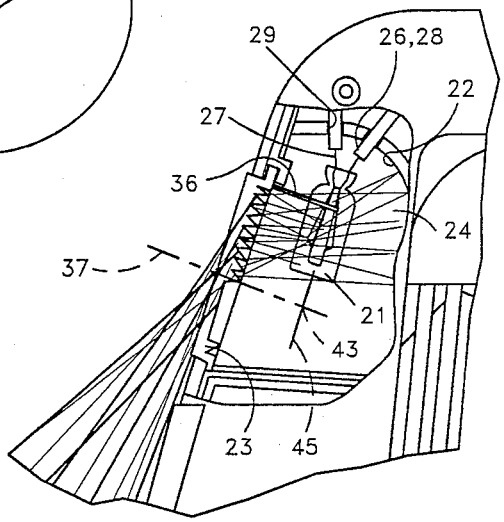
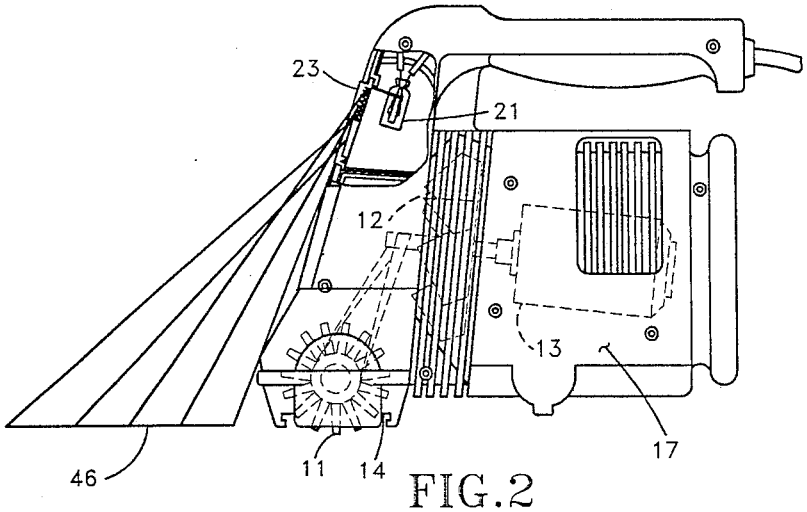
FIG. 2

FRESNEL LENS ILLUMINATOR FOR VACUUM CLEANER

The invention relates to improvements in vacuum cleaners and more particularly to an improved system for illuminating a work area being cleaned by a vacuum cleaner.

PRIOR ART

It is known, for example, from U.S. Pat. No. 2,208,523 to Cullman to provide a prismatic lens in a vacuum cleaner to directionally control the light beam emitted by an electric light bulb in the housing of a vacuum cleaner and to focus it on the work area just ahead of the cleaner.

In general, prior art vacuum cleaners provided with illumination systems have required expensive components and, consequently, have had limited application. In particular, prior art illumination systems have been considered too expensive to be incorporated in relatively small price competitive units such as hand-held cleaners.

SUMMARY OF THE INVENTION

The invention provides an illumination system for a vacuum cleaner which achieves a level of efficiency that makes it practical to use an electric light bulb of both low wattage and low voltage. A low wattage bulb in this application reduces the relative cost of the bulb and offers an average service life substantially greater than that of the appliance. Where the vacuum cleaner is a corded unit operated on utility provided alternating current, a simple motor tap may be used to provide relatively low voltage to the bulb. The low wattage characteristic of the bulb enables it to be mounted in a simplified manner without the need, for example, of a socket to serve as a heat sink. The avoidance of a socket reduces component and assembly labor costs and allows an inexpensive bulb to be used in the illumination system.

The illumination system provides a sectioned lens including Fresnel-type prisms symmetrically arranged about a central axis. Preferably, the lens is molded with a smooth exterior surface which compliments the exterior surface of the vacuum cleaner housing and an interior surface which provides the prisms. As disclosed, the bulb is positioned above the lens axis so that its light rays are refracted or focused downwardly at a sharp angle close to the exterior face of the vacuum cleaner. This ensures that the area immediately in front of the cleaner is directly illuminated by the light bulb. A strategically selected section of the lens below the axis is without prisms but is frosted to diffuse light striking it from the bulb so as to soften the light image created by those rays generally passing through the lens on a direct line of sight between the bulb and the illuminated work area.

BRIEF DESCRIPTION OF THE DRAWINGS

FIG. 1 is a perspective view of a hand-held vacuum cleaner incorporating the invention;

FIG. 2 is an elevational view, partially in section, of the vacuum cleaner and illustrating the light beam generated by the illumination system of the invention;

FIG. 2*a* is a fragmentary view similar to FIG. 2 but on an enlarged scale.

DESCRIPTION OF THE PREFERRED EMBODIMENT

Figure 4:
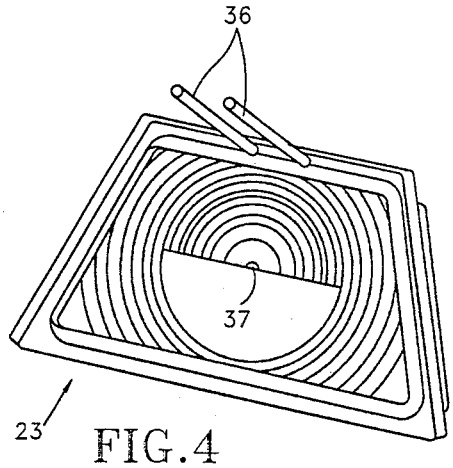
FIG. 4 is a rear perspective view of the spatial relation of a molded lens and light bulb of the illumination system.
Figure 3:
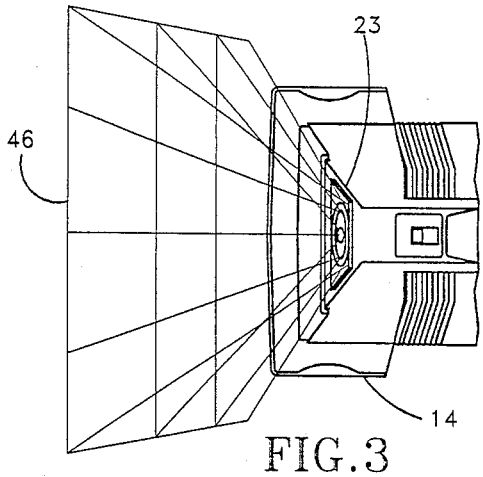
FIG. 3 is a plan view of a portion of the vacuum cleaner and the work area illuminated by the illumination system immediately in front of the cleaner.

A hand-held vacuum cleaner incorporating the invention is illustrated in FIG. 1 at 10. A description of its internal working parts is given in U.S. patent application Ser. No. 031,524, filed Mar. 26, 1987, the disclosure of which is incorporated herein by reference.

The vacuum cleaner 10 includes a housing 17 of opaque thermoplastic material such as ABS fabricated with conventional injection molding techniques. Preferably, as illustrated an FIG. 2, the vacuum cleaner 10 includes a rotary brush 11 and a vacuum fan 12 both operated by an electric motor 13. The brush 11 operates in a nozzle 14. Dirt entrained by air drawn up into the nozzle 14 by the fan 12 is collected in a bag 16.

The nozzle 14 of the housing 17 and brush 11 are swept over an area to be cleaned such as the surface of a rug or upholstery. A system for illuminating an area immediately in front of the nozzle 14 includes an electric light bulb 21, a reflector 22, and a lens 23. The bulb 21 is carried in a cavity 24 integrally formed in the housing 17. A rear face of the cavity forms the reflector 22. The cavity reflector 22 may be covered or coated with a highly reflective material, if desired, but it has been found that where the thermoplastic material forming the housing 17 is a light colored material, the natural reflectivity of such material is sufficient to serve as a light reflecting surface. The reflector 22 is formed or molded with an arc which generally has its radius of curvature located at the center or filament area of the bulb 21.

A suitable incandescent electric light bulb, by way of example, has the following characteristics:

Bulb Designation: #12 PS, T-2 with Wire Terminals
Design volts—12.0
Average amps—0.17
MSCP—2000 (mean spherical candlepower)
Filament—C-2F
Maximum overall length—0.98 inches
Average Wattage—2.04 watts The identified bulb operates at a relatively low voltage, e.g. 12 volts, and a relatively low wattage. The bulb 21 is supported in the housing cavity 24 by a pair of lead wires 26 crimped on respective wire terminals 27 of the bulb 21 with conventional flat wire wrap. The crimped terminal and lead wire areas are covered with conventional shrink tubing for electrical insulation and mechanical support.

The lead wires 26 are frictionally retained in selected positions in grooves 29 formed in sections of the wall of the housing 17. The grooves 29 are situated at a central longitudinally extending plane at which opposite sides of halves of the housing 17 abut in the manner of a clam shell.

Figure 6:
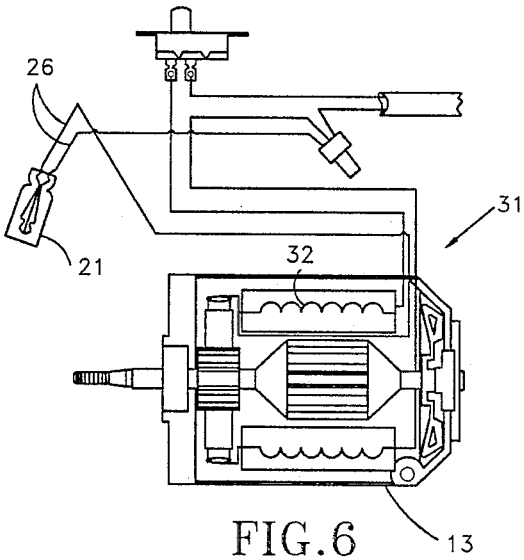
FIG. 6 is a circuit diagram showing the relationship of the light bulb and winding of a motor of the vacuum cleaner.

The motor 13 preferably operates on single phase alternating current at 120 volts and is of the universal type. FIG. 6 illustrates an electrical motor tap circuit 31 for providing nominal 12 volts AC to the bulb 21. As shown, the bulb 21 is connected by the lead wires 26 in parallel with a portion of a field coil 32 at appropriate tapping points across which the voltage is approximately 12 volts.

The lead wires 26 are sufficiently rigid in relation to the mass of the light bulb 21 to exclusively hold the bulb in fixed relation to the lens 23. Because the bulb 21 is of relatively low wattage, it does not require a metal socket to serve as a heat sink and the cost of such a socket and mating elements on the bulb are avoided. If desired, the lens 23 can include aligning means 36, for example, in the form of integral arms to locate the bulb 21 in an ideal position relative to the lens. In the illustrated case, the arms 36 are elongated cylindrical pins extending generally perpendicular from the plane of the lens 23 and are spaced parallel from one another at a distance generally equal to the width or diameter of the bulb. The pins 36 are symmetrically disposed on opposite sides of an imaginary optical axis 37 of the lens 23.

Figure 5:
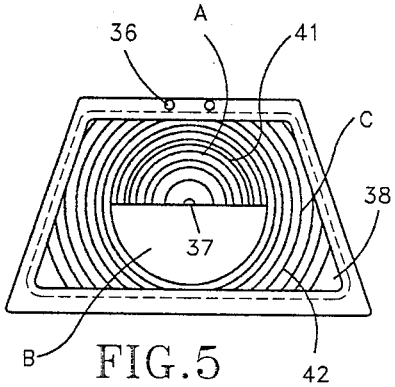
FIG. 5 is a rear view of the lens of the illumination system.

The lens 23 is preferably injection molded of a transparent thermoplastic material such as polycarbonate. As indicated in FIGS. 4 and 5, a rear face 38 of the lens 23 has semi-circular central sections A and B and outer concentric section C. Sections A and C have arcuate prisms 41, 42 that have their center of curvature on the optical axis 37. The prisms 41 in section A are arranged to provide a focal surface that intersects the optical axis 37. The focal surface and focal point lie within the housing as close as possible to the lens. The bulb 21 is positioned such that its filament lies somewhat above the optical axis close to the focal surface and in the space between the focal surface and the lens. In this manner, light rays emanating from the bulb are refracted in a downward direction and also fan out as illustrated in FIG. 2.

An advantage of this arrangement is the fact that the light source occupies a position of close proximity to the lens. The light rays emanating from the filament would ordinarily be totally internally reflected when striking the region C. Accordingly, the prisms 42 are arranged so that light striking the prisms is reflected out of the lens area C and downward the same as that achieved in section A, thus increasing the available light output from the lamp. The method of light control in area C is analogous to light being totally internally reflected by a right angle prism when the angle of incidence exceeds the critical angle.

The area or section B of the rear lens face 38 is generally flat and devoid of prisms but rendered translucent by forming its surface against an injection molding die surface which has been sand-blasted or otherwise etched. The resulting texture of surface B serves to diffuse light rays passing through it to avoid hot or bright spots in the illuminated work area 46 which could otherwise be created by rays passing along a direct line of sight from the bulb to the work area intended to be illuminated. It will thus be seen that this translucent area lies directly between the bulb and the work area immediately ahead of the cleaner nozzle.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

We claim:

1. A vacuum cleaner including a housing having an inlet nozzle for collecting dirt, a motor and a fan within the housing adapted to suck dirt and air into the nozzle, an electric light bulb in the housing, lens means for focusing light from the bulb on a work area immediately adjacent the nozzle, circuit means for operating the bulb on a relatively low voltage, the lens focusing means being sufficiently effective to permit the bulb to operate at a relatively low voltage and without a socket operating as a heat sink.

2. A vacuum cleaner set forth in claim 1, wherein said housing is fabricated primarily of thermoplastic injection molded material.

3. A vacuum cleaner as set forth in claim 2, wherein said lens means is a thermoplastic injection molded element.

4. A vacuum cleaner as set forth in claim 3, wherein said lens means includes elements arranged to locate said bulb relative to said lens by a direct contact therewith.

5. A vacuum cleaner having a housing forming an inlet nozzle, an electric light bulb in the housing, a lens carried on the housing for focusing light from the bulb onto a work area immediately adjacent the area underlying the nozzle, the lens having a plurality of arcuate prisms each substantially concentric to a common imaginary axis, the light bulb being supported in the housing above said axis whereby the light rays passing through said prisms are all directed downwardly towards said immediately adjacent work area.

6. A vacuum cleaner as set forth in claim 5, wherein a portion of said lens intermediate said bulb and said immediately adjacent work area is devoid of prism structure.

7. A vacuum cleaner as set forth in claim 6, wherein said lens portion is translucent.

* * * * *